US005239329A

United States Patent [19]

Evatt

[11] Patent Number: 5,239,329

[45] Date of Patent: Aug. 24, 1993

[54] PHOTOGRAPHIC RETOUCHING IMPLEMENT

[76] Inventor: Tonya A. Evatt, P.O. Box 1584, Alamogordo, N. Mex. 88310

[21] Appl. No.: 848,661

[22] Filed: Mar. 9, 1992

[51] Int. Cl.[5] ..... G03D 15/00

[52] U.S. Cl. ..... 354/348

[58] Field of Search ..... 354/348, 354

[56] References Cited

U.S. PATENT DOCUMENTS 4,343,876 8/1982 Heiart et al. ..... 430/311 X 4,518,666 5/1985 Quinn ..... 430/311 X 4,663,639 5/1987 Owen et al. ..... 346/140 R

OTHER PUBLICATIONS

Retouching Your Photographs by Jan Way Miller; published by Amphoto in 1986.

*Primary Examiner*—D. Rutledge

[57] ABSTRACT

A process of retouching photographs by combining a fine nib marker or nonmetallic nib pen with retouching dye. With the dye premixed and pre-inserted having the availability of various hues and tonal values.

9 Claims, 1 Drawing Sheet

PHOTOGRAPHIC RETOUCHING IMPLEMENT

BACKGROUND OF THE INVENTION

1. Field of the Invention

The present invention relates to retouching photographs. More specifically, the present invention relates to the process of photographic retouching.

2. Prior Art

During the process of printing photographs, white spots are sometimes visible on the finished print. The white spots are caused by particles of dust either on the enlarging lens or on the negative itself during the printing exposure. The process of retouching these white spots is sometimes referred to as "spotting".

There are two existing processes for retouching the white spots, with the first named more popular than the latter. The first and most common process of retouching white spots on prints is with a fine sable brush, saucer and retouching dye. Such retouching is described in, Darkroom Handbook by Michael Langford Rev. ed. 1986, pages 110 and 136. The dye is mixed with water in the saucer until the shade of the dye matches the area of the print in which the white spot appears. The dye is then applied to the white spot with the sable brush until the white spot has been blended with its immediate surrounding area.

The second and least practiced of the two processes is retouching with a technical pen. The dye mixing procedure is much the same as with the brush technique. The difference is that once the dye is mixed it is inserted into the technical pen for application. The two processes share much of the same disadvantages. They are both time consuming and messy. The technical pen process has an additional disadvantage. When applying the dye the metal nib of a technical pen has a tendency to blob, rather than leaving a thin layer of dye as needed. In addition to this disadvantage the quantity of dye needed to adequately fill the technical pen is much greater than what is actually needed to retouch the white spot. This dye mixture is disposed of after each application to make the technical pen available for the next application, which may have a white spot in an area of different hue or tonal value.

Prior to this invention there is no known photographic retouching process in which the retouching dye is pre-inserted into the reservoir of the retouching implement in addition to having a nonmetallic nib.

SUMMARY OF THE INVENTION

The principal object of the present invention is to provide a process of retouching white spots on photographs in which the inconvenience of mixing and matching dye is eliminated, in addition a process in which the nib provides an even distribution of dye.

It is also an object of the present invention to simplify and therefore quicken the process of retouching white spots on photographs.

The foregoing objects can be accomplished by the pre-insertion of comprising dye into a pen or marker implement having a fine nonmetallic nib, making available a series of these implements each said implement of the series containing comprising dye and its own hue and tonal value.

DETAILED DESCRIPTION

Figure 1:
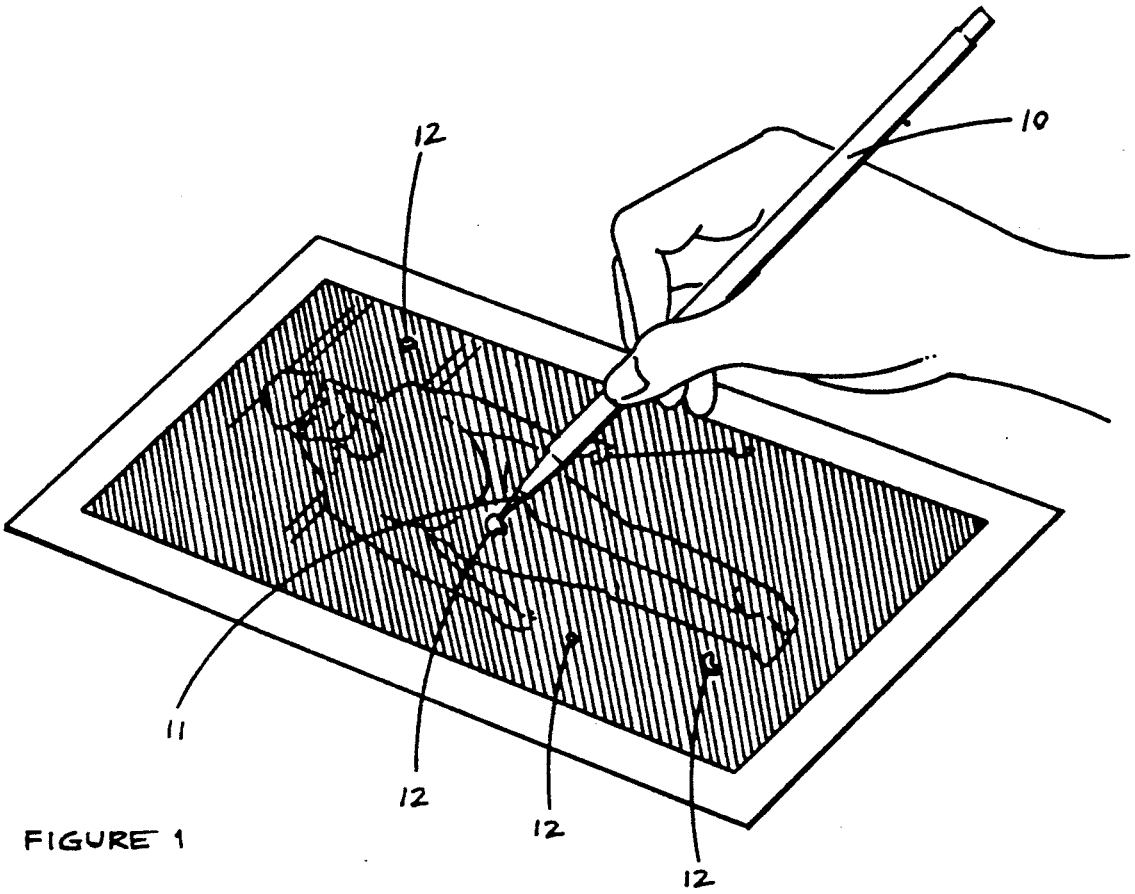
FIG. 1 is a perspective view of a photograph with white spots being retouched with comprising dye distributed by an implement having a fine nonmetallic nib.
Figure 2:
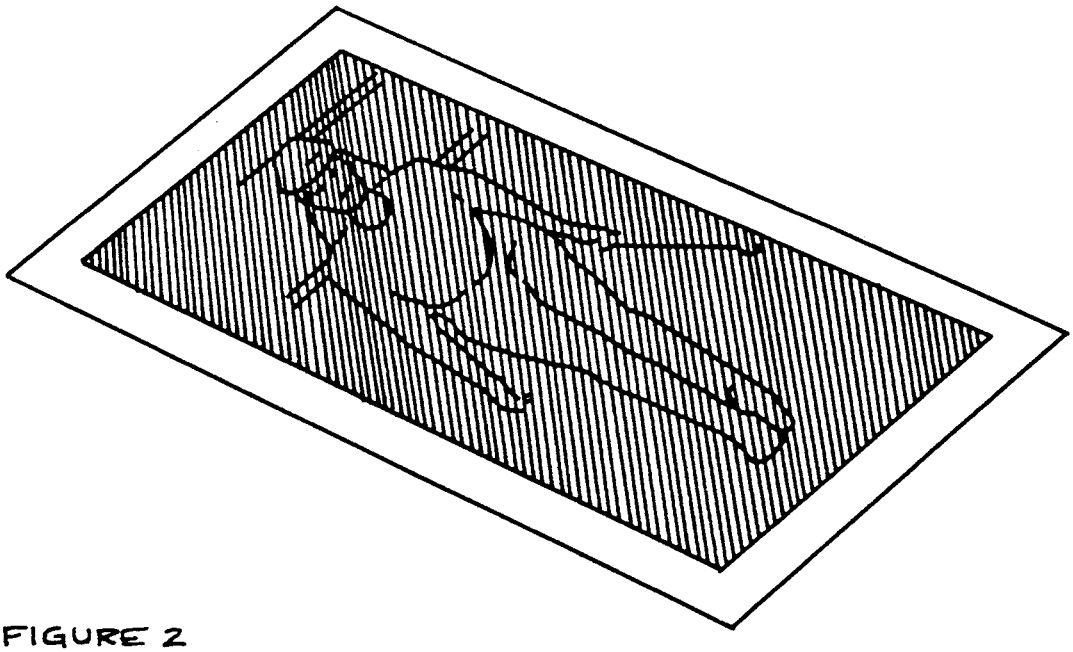
FIG. 2 is a perspective view of the photograph after the white spots have been retouched using said implement.

As shown in FIG. 1, the preferred process for retouching white spots 12 on photographs would consist of an implement 10 having a fine nonmetallic nib 11 for even and controlled distribution of comprising dye and coated within the body of said implement 10 a reservoir for the purpose of storing comprising dye. Said implement 10 is equivalent to any fine nib marker or nonmetallic nib pen. It is necessary for the implement 10 to contain comprising dye. Making available a series of these implements 10 each containing dye with its own range of hue and tonal value will eliminate the process of manually mixing and matching the dye.

As best seen in FIG. 1, the implement 10 containing the comprising dye having the hue and tonal value equal to the area in which the white spot 12 appears is chosen and applied. As best seen in FIG. 12, the process is complete when all the white spots 12 have been blended with their immediate surrounding area. Said process is also useful in hand coloring or hand tinting photographs.

The foregoing description of the preferred embodiment of the invention has been presented for the purpose of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

I claim:

1. A process of retouching photographs with an implement having a fine non-metallic nib for even and controlled distribution of a photographic retouching dye, said fine non-metallic nib is attached to an elongated body having a reservoir for the purpose of storing a liquid comprised of photographic retouching dye; and wherein said implement does not require the photographic retouching dye to be pre-mixed by the user prior to use; wherein the process of retouching photographs comprises the steps of:

identifying an area of a photograph to be corrected;

selecting an implement comprising a hue or tonal value of retouching dye that matches an area adjacent to the area to be corrected;

applying the nib to the area of the photograph to be corrected so as to transfer the retouching dye to the area.

2. A process defined in claim 1, wherein said implement is available in a series in which each said implement of the series contains photographic retouching dye with its own range of hue and tonal value.

3. A process of retouching photographs with a pen having a fine non-metallic nib for even and controlled distribution of photographic retouching dye, said fine non-metallic nib is attached to an elongated body having a reservoir for the purpose of storing a liquid comprising of photographic retouching dye; and wherein said pen does not require the photographic retouching dye to be pre-mixed by the user prior to use; wherein the process of retouching photographs comprises the steps of:

identifying an area of a photograph to be corrected;

selecting an implement comprising a hue or tonal value of retouching dye that matches an area adjacent to the area to be corrected;

applying the nib to the area of the photograph to be corrected so as to transfer the retouching dye to the area.

4. A process defined in claim 3, wherein said pen is available in a series in which each said pen of the series contains photographic retouching dye with its own range of hue and tonal value.

5. A process of retouching photographs with a marker having a fine non-metallic nib for even and controlled distribution of photographic retouching dye; said fine non-metallic nib is attached to an elongated body having a reservoir for the purpose of storing a liquid comprised of photographic retouching dye; and wherein said marker does not require the photographic retouching dye to be pre-mixed by the user prior to use; wherein the process of retouching photographs comprises the steps of:

identifying an area of a photograph to be corrected;

selecting an implement comprising a hue or tonal value of retouching dye that matches an area adjacent to the area to be corrected;

applying the nib to the area of the photograph to be corrected so as to transfer the retouching dye to the area.

6. A process defined in claim 5, wherein said marker is available in a series in which each said marker of the series contains photographic retouching dye with its own range of hue and tonal value.

7. A process of retouching photographs in which a pre-recorded color or hue will be changed to a desired tonal value or hue; the process uses an implement having a fine non-metallic nib for even and controlled distribution of photographic retouching dye; said fine non-metallic nib is attached to an elongated body having a reservoir for the purpose of storing a liquid comprised of photographic retouching dye; and wherein said implement does not require the photographic retouching dye to be pre-mixed by the user prior to use; wherein the process or retouching photographs comprises the steps of:

identifying an area of a photograph to be changed to the desired tonal value or hue;

selecting an implement comprising a tonal value or hue of retouching dye that matches the desired color or hue;

applying the nib to the area of the photograph to be changed so as to transfer the retouching dye to the area.

8. A process or retouching photographs according to claim 7, wherein the implement is a pen.

9. A process or retouching photographs according to claim 7, wherein the implement is a marker.

* * * * *

US005239329B1

REEXAMINATION CERTIFICATE (4009th)

United States Patent [19] [11] B1 5,239,329

Evatt [45] Certificate Issued Mar. 7, 2000

[54] PHOTOGRAPHIC RETOUCHING IMPLEMENT

[75] Inventor: Tonya A. Evatt, P.O. Box 1584, Alamogordo, N. Mex. 88310

[73] Assignee: Tonya A. Evatt, Alamogordo, N. Mex.

Reexamination Request:
No. 90/004,932, Mar. 2, 1998

Reexamination Certificate for:

| | |
|---|---|
| Patent No.: | **5,239,329** |
| Issued: | **Aug. 24, 1993** |
| Appl. No.: | **07/848,661** |
| Filed: | **Mar. 9, 1992** |

[51] Int. Cl.[7] ..... G03D 15/00
[52] U.S. Cl. ..... 396/655
[58] Field of Search ..... 396/655

[56] References Cited

PUBLICATIONS

Excerpt from 1989–1990 FaberCastell catalog.
Copy of Mar. 1991 FaberCastell brochure featuring the Design 2 Art Market.
Excerpt from 1987 Charrette catalog.
Excerpt from 1992 Eberhard Faber catalog.

*Primary Examiner*—D. Rutledge

[57] ABSTRACT

A process of retouching photographs by combining a fine nib marker or nonmetallic nib pen with retouching dye. With the dye premixed and pre-inserted having the availability of various hues and tonal values.

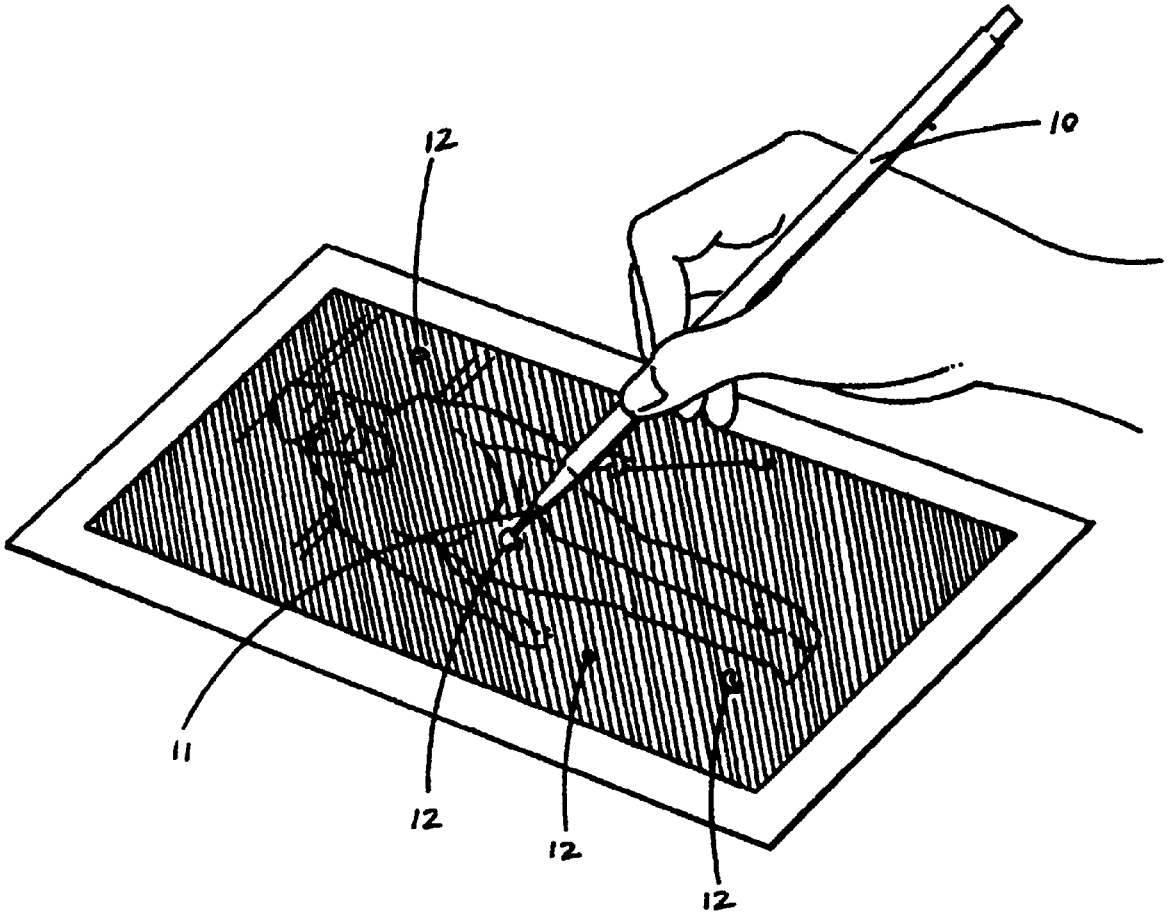

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–9 is confirmed.

* * * * *